United States Patent [19]

Felix et al.

[11] 3,958,305

[45] May 25, 1976

[54] METHOD OF AND AN APPARATUS FOR UNIFORMALIZING COMBING MACHINE SLIVERS

[75] Inventors: Ernst Felix; Hans Locher, both of Uster, Switzerland

[73] Assignee: Zellweger, Ltd., Switzerland

[22] Filed: Oct. 30, 1973

[21] Appl. No.: 411,177

[30] Foreign Application Priority Data

Oct. 30, 1972 Switzerland ..... 15796/72

[52] U.S. Cl. ..... 19/215; 19/240

[51] Int. Cl.[2] ..... D01G 19/00; D01H 5/38

[58] Field of Search ..... 19/240, 232, 225, 215, 19/243, 239

[56] References Cited

UNITED STATES PATENTS 3,105,997 10/1963 Mackie ..... 19/243

FOREIGN PATENTS OR APPLICATIONS 933,835 8/1963 United Kingdom ..... 19/225

*Primary Examiner*—Dorsey Newton

*Attorney, Agent, or Firm*—Craig & Antonelli

[57] ABSTRACT

In order to compensate the combing periods in density fluctuation machine slivers, the density of each of a plurality of slivers is measured to detect the phase positions of the combing periods therein and then the relative positions of the respective slivers are adjusted to place the combing periods in each sliver out of phase with the combing periods in the other slivers before the slivers are combined. The adjustment of the phase position of the slivers is effected by varying the length of the path of the sliver between the combing machine and the point where the slivers are combined.

14 Claims, 7 Drawing Figures

METHOD OF AND AN APPARATUS FOR UNIFORMALIZING COMBING MACHINE SLIVERS

One of the requirements for a uniform yarn are the provision of rovings and slivers of uniform cross section. Considerable efforts are now being made to produce uniform slivers by means of regulating systems, especially in card rooms.

In cotton spinning processes, the combing machine represents a special case insofar as fairly pronounced periodic fluctuations in sliver density, so-called combing periods, can occur in them. These combing periods might also be referred to as density fluctuation periods such as those caused by piecing up the trailing and leading ends of fibers during the combing operation. These periods have to be neutralized by subsequent drafting and doubling or by means of regulating systems. Accordingly, considerable outlay is involved in such operations either in terms of labor or in terms of investment in special equipment.

The present invention relates to a method for eliminating or neutralizing the density fluctuation periods in combing machine slivers, and is distinguished by the fact that the phase position of the density fluctuation periods of the individual combing machine outputs are regulated and/or controlled in such a way that they are sufficiently out of phase with each other to at least substantially compensate one another.

The invention also relates to an apparatus for carrying out this method, comprising means for determining the phase position of the density fluctuation periods of the individual combing machine outputs, and elements by which it is possible to obtain a change in the phase position of the density fluctuation periods of the respective slivers in dependence upon a control signal.

One embodiment of the invention is described in more detail in the following with reference to the accompanying drawings, wherein.

Figure 1:
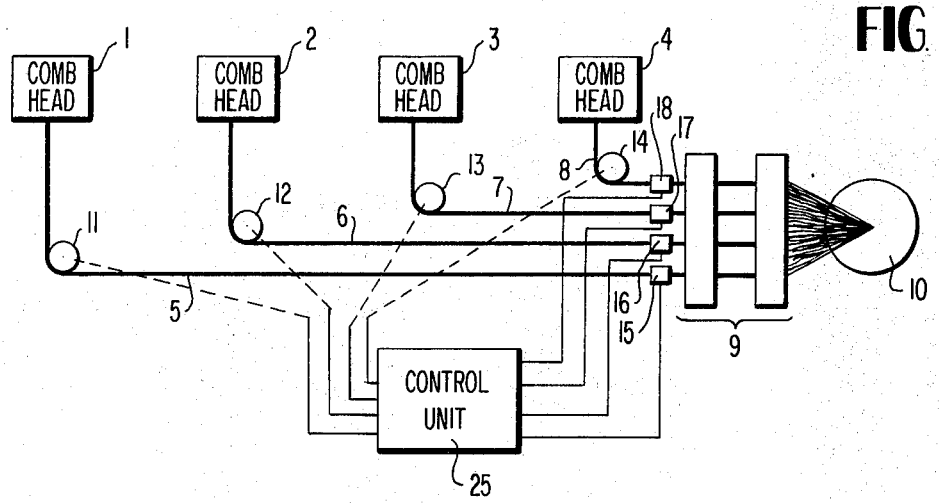
FIG. 1 is a schematic diagram illustrating a combing machine with four combing machine heads.

FIG. 1 diagrammatically illustrates a combing machine with four combing machine heads 1, 2, 3, and 4. In conventional combing machines, the combed slivers 5, 6, 7, and 8 issuing from the machine heads are diverted through approximately 90° and delivered together and drafted in a drawing frame 9 built onto the combing machine, after which they are deposited into a can 10.

Theoretically, it would be possible, for example, with the diverting elements shown in FIG. 1 in the form of round bars 11, 12, 13, and 14 to adjust the relative phase positions of the individual outputs 1, 2, 3, and 4 in such a way that the density fluctuation periods of the slivers 5, 6, 7, and 8 are substantially neutralized on entry into the drawing frame 9. However, this is not possible in practice because, for example, minor changes in tension of the kind that can occur through variation of the sliding properties on the combing machine table (not shown), give rise to varying degrees of elongation in the slivers 5, 6, 7, and 8 which makes an illusion of the required phase compensation.

However, it is now possible with measuring elements 15, 16, 17, and 18, which are known per se (for example, capacitive measuring elements or active pneumatic measuring elements), to measure the cross section of the individual slivers or at least the phase position of the density fluctuation period of the individual slivers and to vary the position of the diversions 11, 12, 13, and 14 by means of a control unit 25 connected to the outputs of the measuring elements 15 – 18 in such a way that the density fluctuation periods of the entire sliver or web deposited into the can 10 are again compensated through the resulting changes in the length of the path of each combing machine sliver between the combing machine heads 1, 2, 3, and 4 and a take-up unit such as, for example, the feed roller of the drawing frame 9.

Figure 5:
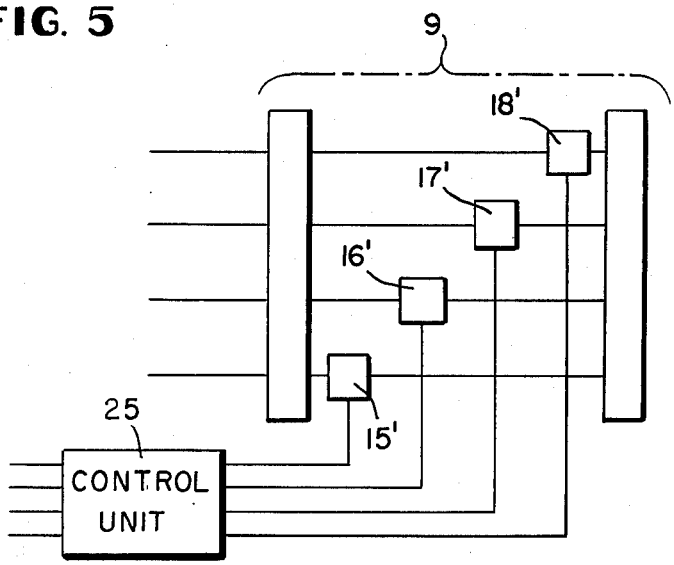
FIG. 5 is a schematic diagram of another embodiment of applicants' invention showing measuring elements located between the drawing rollers of the drawing frame.

In some cases, the density fluctuation period can only be clearly detected after drafting. Accordingly, it is of advantage in some cases to determine the sliver cross section between the drawing rollers by means of the measuring elements 15', 16', 17', 18' such as shown in FIG. 5, or immediately after the sliver leaves the drawing frame.

Figure 2:
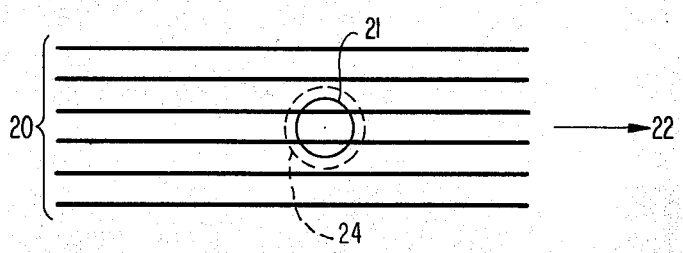
FIG. 2 is a diagram of one possible embodiment for photoelectric scanning of a sliver.

The measurement of cross section does not have to be particularly accurate. It can also be approximate because it is merely required to determine the phase position of the density fluctuation period. In some cases, therefore, partial measurement of the combing machine sliver is entirely adequate. One embodiment of a partial measurement system is, for example, a photocell with a light source which illuminates only part of the sliver and impinges on a photosensitive element on the other side of the sliver. This principle is diagrammatically illustrated in FIG. 2 in which the reference 20 denotes the combing machine sliver, the reference 21 the light source and reference 24 the photocell. The arrow 22 indicates the direction of movement of the sliver.

Figure 3:
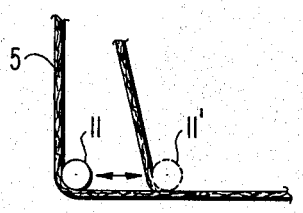
FIG. 3 is a schematic diagram of one possible embodiment for displacement of the phase position of the combing periods.
Figure 4:
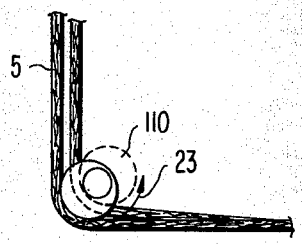
FIG. 4 is a schematic diagram of another embodiment for displacement of the phase position of the combing periods.

The change in path is particularly easy to achieve and can be produced simply by changing the position of the corresponding diverting elements 11, 12, 13, and 14. For example, position changes can be made either by translating the axis of the diverting elements towards and away from the drawing frame, as shown in FIG. 3, or towards and away from the combing machine output. However, it is also possible, for example, as shown in FIG. 4, to provide the diverting elements in the form of eccentrically mounted bars 110, in which case the change in path is obtained by correspondingly turning the bars 110 in the direction of arrow 23.

Figure 6:
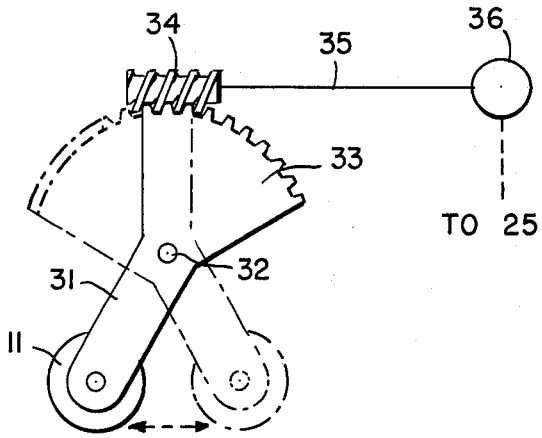
FIG. 6 is a schematic diagram of one possible displacement system for the diverting element shown in FIG. 3.

One possible displacement system for the diverting elements is illustrated in FIG. 6. This system could be used to translate the axis of the diverting elements towards and away from the drawing frame as shown in FIG. 3. As can be seen in FIG. 6 which shows one of the diverting elements, element 11 is mounted on one end of lever 31 which is rotatably journalled on an axis 32. The other end of lever 32 is made as a sector 33 of a worm gear which meshes with a worm 34 mounted on a motor driven axis 35. Motor 36 which drives the worm is controlled by control unit 25. Consequently, as worm 34 is driven by motor 36, lever 31 is caused to rotate on axis 32 so as to translate the axis of the diverting element mounted thereon towards and away from the drawing frame.

Figure 7:
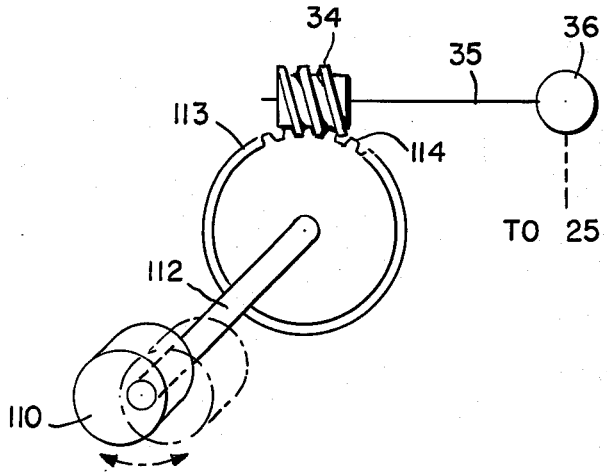
FIG. 7 is a schematic diagram of one possible displacement system for the diverting element illustrated in FIG. 4.

Another possible displacement system for the diverting elements is illustrated in FIG. 7. This system could be used to translate the axis of the diverting elements towards and away from the combing machine output. As illustrated in FIG. 7 which shows one of the diverting elements, eccentrically mounted bar 110 is rigidly affixed on one end of rod 112. The other end of rod 112 is attached to plate 113 having along a portion of its circumference a sector 114 of a worm gear which meshes with the worm 34 mounted on the motor driven axis 35. As worm 34 is driven by the motor 36, rod 112 is rotated and the axis of the diverting element mounted thereon is translated towards and away from the combing machine output.

In the past, it has only been necessary to obtain at least substantial compensation of the density fluctuation periods. Compensation is actually obtained when a pair of slivers enters the drawing frame 9 with a 180° phase displacement of the density fluctuation period with respect to adjacent slivers. In the embodiment shown in FIG. 1, however, it is of particular advantage for the density fluctuation periods of each of the four outputs to have a phase displacement of 90°. In the case of five slivers, the phase displacement would be 72°, etc.

The control unit 25 may take the form of any conventional phase control system wherein the outputs of the measuring elements 15 – 18 are compared in respective comparators to suitably generated timing signals having phases of 0°, 90°, 180°, and 270°, in the case of four outputs as in the system of FIG. 1. The outputs of the comparators (if any) would represent the misalignment error and be used to adjust the corresponding diverting element in the manner described above.

What is claimed is:

1. A method for compensating the density fluctuation periods in combing machine slivers such as caused by piecing up the trailing and leading ends of fibers during the combing operation comprising the steps of measuring the density of each of a plurality of slivers derived from the output of the comb heads of a combing machine to detect the phase positions of the density fluctuation periods therein, comparing the detected phase positions to reference values having predetermined phase relationships to determine respective misalignment errors in the detected phase positions, adjusting the relative positions of the respective slivers to place the density fluctuation periods in each sliver out of phase with the density fluctuation periods in the other slivers by a predetermined value, in response to the respective misalignment errors, and drafting the adjusted slivers.

2. A method as defined in claim 1 wherein the phase position of the density fluctuation periods is measured before the slivers enter a drawing frame in which the drafting occurs.

3. A method as defined in claim 1 wherein the phase position of the density fluctuation periods is measured in a drawing frame where the drafting occurs.

4. A method as defined in claim 1 wherein said measuring is accomplished by passing light through at least a portion of a sliver and detecting the intensity of the light passing through the sliver.

5. A method as defined in claim 1 wherein said adjusting of the relative positions of the respective slivers is effected by adjusting the length of the path of the sliver between the output of the comb heads of the combing machine and the entrance of the slivers into a drawing frame.

6. An apparatus for compensating the density fluctuation periods in combing machine slivers such as caused by piecing up the trailing and leading ends of fibers during the combing operation, comprising measuring means for measuring the density of each of a plurality of slivers derived from the comb heads of a combing machine to detect the phase positions of the density fluctuation periods therein, comparing means for comparing the detected phase positions to reference values having predetermined phase relationships to determine misalignment errors in the detected phase positions and issuing an output representative thereof, adjusting means for adjusting the relative positions of the respective slivers to place the density fluctuation periods in each sliver out of phase with the density fluctuation periods in the other slivers by a predetermined value, in response to the output of said comparing means, and means for drafting said slivers.

7. An apparatus as defined in claim 6 wherein head and said adjusting means comprises a cylindrical member for each sliver movably positioned to determine the length of the path for the respective sliver between the combing machine head and the drafting means.

8. An apparatus as defined in claim 7 wherein said measuring means comprises measuring elements positioned at the input of said drafting means for measuring respective slivers.

9. An apparatus as defined in claim 7 further comprising mounting means for mounting said cylindrical members so as to enable said cylindrical members to be displaceable in the direction of the moving sliver.

10. An apparatus as defined in claim 7 wherein the cylindrical members are in the form of eccentrically mounted cylindrical bodies and said adjusting means further includes means for turning said cylindrical bodies about their eccentric axes in response to the output of said measuring means.

11. An apparatus as defined in claim 7 further comprising mounting means for mounting said cylindrical members so as to enable said cylindrical members to be displaceable in a direction having a component perpendicular to the direction of the moving sliver.

12. An apparatus as defined in claim 6 wherein said measuring means comprises a plurality of measuring elements each including photoelectric transmitters and receivers.

13. An apparatus as defined in claim 6 wherein said measuring means comprises a plurality of capacitive measuring elements.

14. An apparatus as defined in claim 6 wherein said measuring means comprises a plurality of measuring elements in the form of active-pneumatic primary elements.

* * * * *